US005626180A

United States Patent [19]

Kahn et al.

[11] Patent Number: 5,626,180

[45] Date of Patent: May 6, 1997

[54] PROCESS AND DEVICE FOR CASTING COMPONENTS

[76] Inventors: Friedhelm Kahn; Joachim Kahn, both of Mühlbachstrasse 2, D-35630 Ehringshausen, Germany

[21] Appl. No.: 379,544

[22] PCT Filed: Jun. 3, 1994

[86] PCT No.: PCT/EP94/01813

§ 371 Date: Mar. 16, 1995

§ 102(e) Date: Mar. 16, 1995

[87] PCT Pub. No.: WO94/29050

PCT Pub. Date: Dec. 22, 1994

[30] Foreign Application Priority Data

Jun. 2, 1993 [DE] Germany ..... 43 18 252.6

[51] Int. Cl.[6] ..... B22D 23/00

[52] U.S. Cl. ..... 164/136; 164/336; 164/120

[58] Field of Search ..... 164/136, 336, 164/120, 319

[56] References Cited

U.S. PATENT DOCUMENTS

| | | | |
|---|---|---|---|
| 2,233,405 | 3/1941 | Fahlman | 164/136 |
| 3,333,625 | 8/1967 | Fromson | 164/136 |
| 3,635,791 | 1/1972 | Bly et al. | 164/136 |
| 3,863,704 | 2/1975 | Kahn | 164/136 |
| 4,733,714 | 3/1988 | Smith | 164/136 |
| 5,163,500 | 11/1992 | Seaton et al. | 164/136 |

FOREIGN PATENT DOCUMENTS

| | | |
|---|---|---|
| 1424958 | 12/1965 | France . |
| 377683 | 6/1923 | Germany . |
| 505224 | 7/1930 | Germany . |
| 2164755C3 | 10/1975 | Germany . |
| 2274372 | 8/1990 | Japan . |
| 3118956 | 5/1991 | Japan . |
| 2057937 | 4/1981 | United Kingdom . |
| 2080714 | 2/1982 | United Kingdom . |

*Primary Examiner*—Joseph J. Hail, III
*Assistant Examiner*—Randolph Herrick
*Attorney, Agent, or Firm*—Harness, Dickey & Pierce

[57] ABSTRACT

The invention relates to a process and devices for casting components in metal alloys on the tilt casting principle in which a quantity of melt metered for casting is spread over a large gate cross section without turbulence from a melt container of the mould (30) into the mould (31) by rotating the casting device. To prevent the formation of oxide and weak structural points, the melt is taken from a metering furnace under a protective gas in a melt container connected to the mould and taken thence into the mould also under a protective gas. The melt hardens there under increased gas pressure on the feeder region of the casting, whereby its properties such as fine-grained, dense structure, high stability under load and accurately dimensioned surfaces are considerably improved.

20 Claims, 2 Drawing Sheets

PROCESS AND DEVICE FOR CASTING COMPONENTS

BACKGROUND OF THE INVENTION

The invention relates to a process of and device for casting components, with liquid metal being introduced into a cavity of a mould where it is consolidated. For forming components, starting from the liquid material condition, there is known a large number of different processes and devices which more or less meet the requirements to be complied with by high-quality workpiece in respect of shaping freedom, surface quality and especially optimum material properties. The main difficulties initially concern the operation of filling the mould wherein the initially compact melt volume is divided, with a large surface thereof being exposed to air atmosphere, which, due to certain reactions, leads to the material quality being adversely affected. Molten metal alloys whose alloying constituents react very strongly to oxygen, nitrogen and the water vapour of air are particularly affected. In consequence, the tilting casting method according to Durville for example was applied to sensitive alloys at an early stage.

DE-PS 377 683 proposes a process wherein numerous casings are produced one after the other from an oblong casting container. In the course of the casting operation, the melt container is erected, as a result of which a somewhat higher metallostatic pressure can be achieved. However, with this method, the atmosphere has free access to the melt, so that especially as the container empties, oxide can easily reach the mould cavity from the bath surface. During the solidification of the castings there remains a direct connection with the large melt volume in the casting container, so that the solidification process is slowed down.

DE-PS 505 224 describes a process wherein two moulds alternately filled with melt are mounted on a casting container arranged similarly to a swing. Again, the air has free access to the melt bath with its large surface, so that it is particularly easy for the existing impurities to enter the mould.

DE-PS 21 64 755 describes a high-performance casting process for large series wherein, admittedly, the disadvantages of the above proposals were largely eliminated, but it requires sophisticated, expensive equipment, and even if one single mould fails, the remaining parts are affected as well.

As a rule, during the solidification process, volume contractions and gas segregations cause the component structure to form shrinkholes and pores which have to be eliminated at great expense. The shrinking processes also, locally, lead to the formation of gaps between the surfaces of the casting wall and mould wall, which gaps greatly affect the heat transfer, which also has negative effects on the quality of the structure and leads to sink marks, thus rendering the component useless.

SUMMARY OF THE INVENTION

It is the object of the invention to use new types of processes and casting facilities to create the advantageous conditions required for producing high-quality components, both during the mould filling operation and also during solidification of the castings, and at the same time to permit particularly rational production and eliminate the disadvantages of the above-mentioned processes and devices. The purpose is to avoid turbulence and melt division during the mould filling operation. Furthermore, it is the object of the invention to prevent any reactions of the alloy melt with the gases of the atmosphere and of the mould cavity. Finally, the intention is, preferably, to achieve sharp contours during the filling process and to ensure an optimum fine-grained and dense component structure during the solidification process.

To achieve the objective there are proposed processes and a suitable device having the characteristics of the independent claims, with a sealable container for the melt being connected by a large ingate cross-section to the cavity of the mould which, initially, is positioned above the container.

The ingate constitutes the direct connection between the casting container and the mould cavity and shall be dimensioned in such a way as to avoid the melt being throttled or subjected to turbulence. According to a first proposal, its large cross-section relative to the cross-section of the gated mould cavity and the adjoining mould wall parts of the component may amount to a value in excess of 40%, especially in excess of 50%, of the latter cross-sectional faces. According to a second proposal, the large cross-section relative to the cross-section of the gated mould cavity and the cross-section of the adjoining mould wall parts may amount to a value in excess of 50%, especially in excess of 70% of the latter faces, and preferably extend along their entire length. The ingate communicates with the lowest parts of the mould cavity or the mould wall part prior to the rotating operation. Only their cross-sectional faces extending parallel to the cross-section of the ingate are referred to as gated faces to which the ingate is preferred during the relative dimensioning process.

The casting container is preferably first flushed with protective gas, then filled with a metered quantity of melt under protective gas and sealed so as to be gas-proof, whereupon the container together with the mould is rotated around a horizontal axis in such a way that the melt is conveyed into the mould without forming any preceding tongues or spray.

In a preferred embodiment, the pressure of the protective gas is increased during the mould filling operation end/or the solidification process, and it is advantageous if the protective gas is recovered during the subsequent pressure relieving process.

All processes in accordance with the invention have in common that the casting container is filled with an amount of melt which corresponds to the gross volume of the quantity of melt for one component required for one casting operation and which solidifies in its entirety during the casting operation, with only a small volume of melt forming the feeder volume remaining in the ingate itself or possibly in the casting container.

According to a first process in accordance with the invention, to avoid any oxidation, even the casting container is filled with liquid melt under protective gas, with the application of protective gas being continued while the casting container is rotated together with the mould.

According to an alternative process, a volume of solid metal corresponding to the quantity of melt is introduced into the casting container; only then will the casting container and mould be sealingly connected and the interior flushed with protective gas, whereupon the quantity of melt required for one casting operation is melted in the casting container. Otherwise, the process remains unchanged. In this case, too, any oxidation processes during the liquid phase are successfully avoided.

To improve the structure, the pressure of the protective gas is increased during the solidification process, as a result of which the feeder volume and thus the amount of metal used is reduced, as the excess pressure on the melt surface in the casting container replaces the otherwise common metallostatic pressure of high-level feeders.

According to a further process in accordance with the invention for improving component quality, no protective gas is used in the case of alloys less likely or less at risk to form oxidations, while otherwise retaining the latter process sequence involving the increase in pressure in the inferior of the casting container during the mould filling operation and/or the solidification process in order to achieve the same effects of a reduced use of metal and an improved structure and surface quality of the casting.

According to an alternative process it is possible to introduce the quantity of melt into the casting container either in liquid form or in a solid condition and then melt it in the casting container. Otherwise the process remains unchanged as compared to the previous process.

According to a further process in accordance with the invention for improving castings which, because of the alloys used and/or their shape, are less likely to form shrinkholes or sink marks, the process is carried out without building up an excess pressure, but with a certain amount of melt remaining in the ingate and preferably in part of the casting container after the rotating operation in order to generate a metallostatic pressure.

In this case, too, according to an alternative embodiment of the process, it is possible to introduce the quantity of melt into the casting container either in liquid form or in a solid condition and subsequently melt it in the casting container. Otherwise the process remains unchanged as compared to the above-mentioned process.

The processes in accordance with the invention, in particular, eliminate the risk of impurities and inclusions in the casting in that, as compared to the existing component surface and the gated part of the mould cavity, there is provided a large ingate cross-section or that, as compared to the size of the casting and the mould cavity, there is provided a long ingate in the direction of the rotational axis. As a result, the metal flow from the casting container into the mould is quiet and preferably located below the bath surface so that a defect-free casting is produced.

The ingate with the large cross-section is identical with the feed channel and at the same time constitutes the feeder volume. It forms the direct connection between the interior of the casting container and the mould cavity.

Further embodiments are characterised by a number of considerable advantages. When transferring a metered amount of melt from a motoring furnace into the casting container of the device under protective gas atmosphere, melt oxidation is effectively avoided. This is all the more significant because, with this process, the molten metal stream reaches the casting container under free fall conditions, and unlike conventional operations, there is no large-scale formation of oxide skin, with the melt continuously breaking off, rushing in or whirling. Because of the predetermined large ingate cross-section, the mould filling operation starting as a result of the rotational movement of the equipment can then take place particularly quietly and at a low speed of flow of the melt in a rising mode according to the principle of communicating tubes, which, especially in connection with a protective gas atmosphere also prevailing in the mould cavity, effectively eliminates the risk of foam formation which of course leads to inclusions in the structure of the casting. The front end of the melt remains closed, i.e. the formation of preceding metal tongues or even spray is avoided, thereby also preventing cold runs which are often feared as the cause of rejects in casting operations.

According to a preferred embodiment, the mould cavity for an oblong component is aligned in the direction of the rotational axis, thereby achieving a wide melt front end.

According to a further embodiment, cores are arranged so as to be positioned towards the casting container. As a result, the gated mould wall parts themselves are reduced to end wall parts of the component in order to improve quality.

In the case of castings such as cylinder heads or cylinder crank housings of internal combustion engines, any surfaces having to meet stringent quality requirements are to be arranged at a mould wall positioned opposite the ingate.

Solidification is to be controlled by heating and/or cooling in such a way that it progresses from the component point furthest removed from the casting container in the direction towards the ingate.

According to a preferred embodiment, there is provided a further over-flow channel so as to extend parallel to the ingate, so that initially the gas or air volumes may be balanced in order to avoid the formation of foam.

By closely connecting the casting container to the mould cavity it is possible to achieve extremely short flow distances. The melt reaches its final position over the shortest distance, cools rapidly and solidifies. As a result, it is possible to eliminate the "canalisation effect" which occurs in conventional mould filling operations as a result of metal following or flowing through certain regions over long periods of time.

Said advantages also benefit the subsequent solidification process. First, the thermal conditions in the mould are disturbed to a much lesser extent due to the elimination of the canalisation effects which cause local overheating both in the casting and in the adjoining mould wall regions, thus advantageously affecting control of the solidification process.

Furthermore, an increased, especially variable protective gas pressure during solidification provides special advantages. By greatly increasing the gas pressure, which mainly affects the melt surface which is located at the upper end after completion of the mould filling operation and under which there is positioned the feeder volume of the casting, it is possible to increase the feeder pressure and achieve a largely dense structure of the casting. At the same time, the casting surfaces are firmly pressed against the mould walls and by preventing the formation of damaging gaps, the transfer of heat is intensified.

The above, in turn, shortens the solidification time and increases both the contour sharpness and dimensional accuracy of the castings. In addition, it is possible to eliminate the formation of sink marks at the casting surface which are particularly likely to occur on alloys requiring a long period of solidification. Because the process is limited to the relatively small volume of one single casting, the gas pressure may be increased well beyond the levels permitted with conventional processes such as low-pressure casting processes. Because of the additional use of prior art swell sequence cooling (DE-PS 26 46 060) the improvements referred to are extended in an optimum way. Accordingly, it is proposed to use a process wherein the mould, prior to being filled, is provided with an operating temperature and wherein, after the mould has been filled, cooling takes place in a graduated way in terms of time from the end zones to the feeder zones until the solidification process is complete.

Improvements can also be achieved in respect of the consumption of protective gas because by using a protective gas pump, it is not only possible to apply several bar of pressure, but also to recover the protective gas during the subsequent process of lowering the pressure. In this way, any losses are limited to unavoidable leakages.

When using alloys which, in the molten condition, react less strongly to gases of the atmosphere, it is possible to do without protective gas which, as a rule, is expensive and, instead, to increase the pressure by introducing compressed air, with all the remaining advantages being maintained.

Finally, the processes as proposed are ideal for being carried out in a casting cell sealed against the environment with the objective of eliminating foundry emissions.

For this purpose, it is particularly advantageous to use a combined melting and metering furnace according to DE-PS 20 41 588, which at the same time solves the problem of introducing material charges. A melting furnace is provided with a gas-proof charging chamber with a charging member which conveys a quantified amount of melt into the casting or melt container.

Preferred embodiments of the process are characterized in that the excess pressure in the interior of the casting container is reduced by compressed air.

Another preferred embodiment of the process accordingly is characterized in that the longitudinal axis of the mould cavity for an oblong component extends in the direction of the rotational axis. Also, according to the process a mould cavity is provided with cores extending as far as a component surface is aligned, together with the cores so as to point towards the cross-sectional face of the ingate.

A preferred embodiment of the process for producing a cylinder head of an internal combustion engine with an upper and forming camshaft bearing blocks and a lower and forming combustion chamber faces is characterized in that the mould cavity is arranged in such a way that the upper end of the cylinder head is aligned so as to point towards the cross-sectional face of the ingate.

A preferred process for producing a cylinder crank housing of an internal combustion engine with an upper end receiving a cylinder head and a lower end forming crankshaft bearing blocks is characterized in that the mould cavity is arranged in such a way that the lower end of the cylinder crank housing is aligned so as to point towards the cross-sectional face of the ingate.

A preferred process for producing a cylinder crank housing of an internal combustion engine with an upper end receiving a cylinder head and a lower end forming crankshaft bearing blocks is characterized in that the mould cavity is arranged in such a way that the upper end of the cylinder crank housing is aligned so as to point towards the cross-sectional face of the ingate.

Further preferred embodiments of the process are characterized in that the position of the ingate is adapted to the geometry of the mould cavity in such a way that the melt moves in a turbulence-free way underneath the closed bath surface, in accordance with the principle of communicating tubes, from the casting container into the mould cavity; or in that the casting container is connected to the mould cavity not only by the ingate but also by at least one further over-flow channel; or in that the further over-flow channel extends substantially along the component length, parallel to the ingate.

Preferred embodiments of the process further are characterized in that the ingate and optionally the further overflow channel form the end faces of the outer component walls; that during the mould filling operation or during the solidification process, the pressure in the interior of the casting container is increased up to 100 bar; that for the purpose of evacuating the air, the pressure in the interior of the casting container is reduced down to 0.005 bar; or in that after completion of the filling operation, the thermal conditions in the mould are controlled by cooling processes graduated in terms of time and space.

In a preferred embodiment of the device there are provided sealing means for sealing the casting container in a gas-proof way, and pressure increasing means for increasing the internal pressure in the casting container.

A preferred embodiment of the device is characterized in that the pressure increasing means form part of the protective gas pumping and storing system; or is characterized in that the protective gas pumping and storing system comprises means for returning the protective gas from the casting container into a protective gas store; or is characterized by a metering device, especially a metering furnace for filling the casting container with a quantity of melt for one casting operation; or is characterized by a cooling device for the mould; or is characterized in that the protective gas supply means between the metering furnace and the casting container are formed by a resilient gas-proof coupling especially a convoluted boot; or is characterized in that the gas-proof seal at the casting container is provided in the form of a slide which is positioned in such a way that during the mould filling operation it is not subjected to the pressure of melt.

Other preferred embodiments of the device are characterized in that the casting container is connected to the mould not only by the ingate, but also by at least one further over-flow channel; or in that the further over-flow channel substantially extends along the component length, parallel to the ingate; or in that the width of the ingate is substantially constant and small relative to its length.

Further preferred embodiments of said device are characterized in that the casting container is provided with a heating system; optionally in that the casting container together with a mould is rotatable around a longitudinal axis positioned in a cross-sectional plane of the ingate; or finally in that the entire melting and casting system consisting of a melting and metering furnace, a rotatable casting device with a casting container, and a mould and manipulators for inserting the cores and removing the components is arranged in a closed casting cell.

Advantageous embodiments of the process and device are defined in the sub-claims to whose contents reference is hereby made.

BRIEF DESCRIPTION OF THE DRAWINGS

Below, the invention will be described with the help of embodiments and drawings wherein.

DETAILED DESCRIPTION OF THE PREFERRED EMBODIMENT

Figure 1:
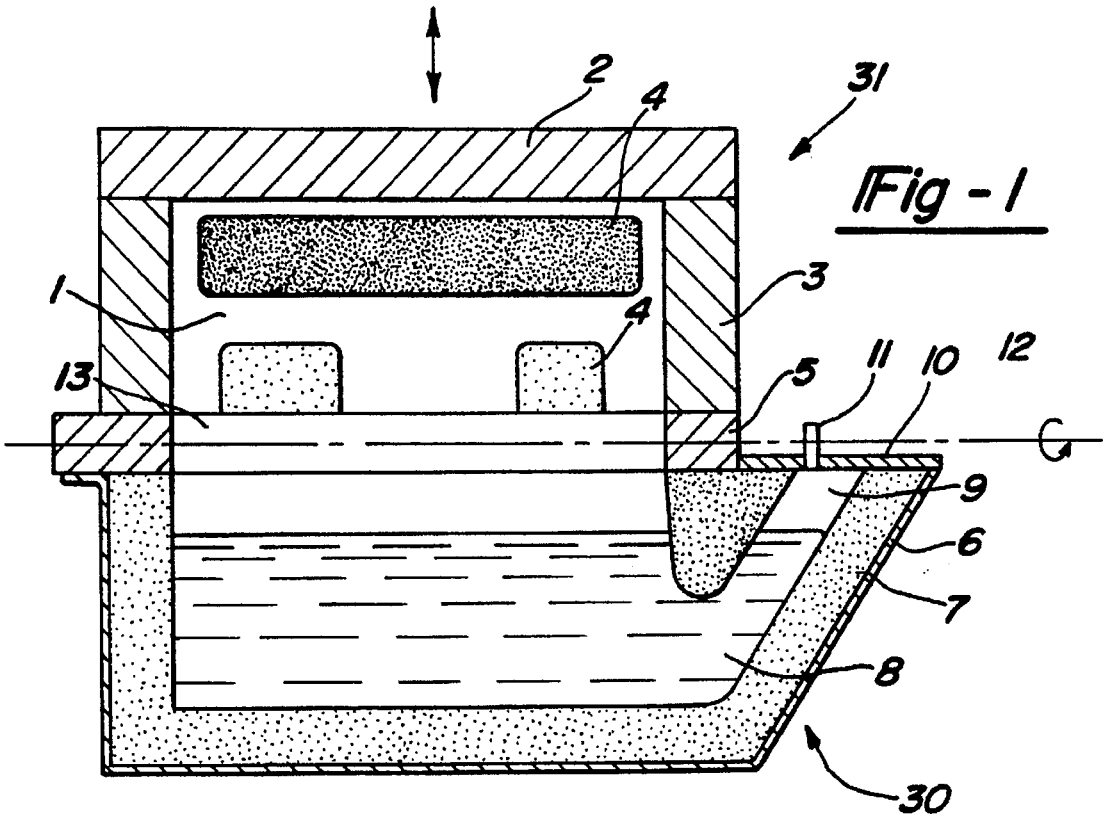
FIG. 1 is a vertical section through a casting container with a mould along the sectional line A-B according to FIG. 2.

In the embodiment according to FIG. 1, a mould 31 with a mould cavity 1 is formed by a mould cover plate 2, side part 3, cores 4 and a mould base plate 5. Below the mould base plate 5 there is positioned a casting container 30 with a housing 6 and a refractory lining 7, which container 30 contains a quantity of melt 8 metered so as to be sufficient for one casting operation. The quantity of melt 8 is introduced, especially under protective gas, by means of a metering furnace (not illustrated) through the filling aperture 9, with the seal being in the open condition. Subsequently, the seal 10 is closed. The seal 10 is shown to have a connection 11 for protective gas. Furthermore, the Figure shows the horizontal rotational axis 12 of the casting device, which extends in the longitudinal direction of the mould 31 and casting container 30. The aperture in the mould base plate 5 is formed by an ingate 13 with a large cross-section.

In arrow above the mould cover plate 2 symbolises the direction of movement of same for removing the finished component from the mould.

Figure 2:
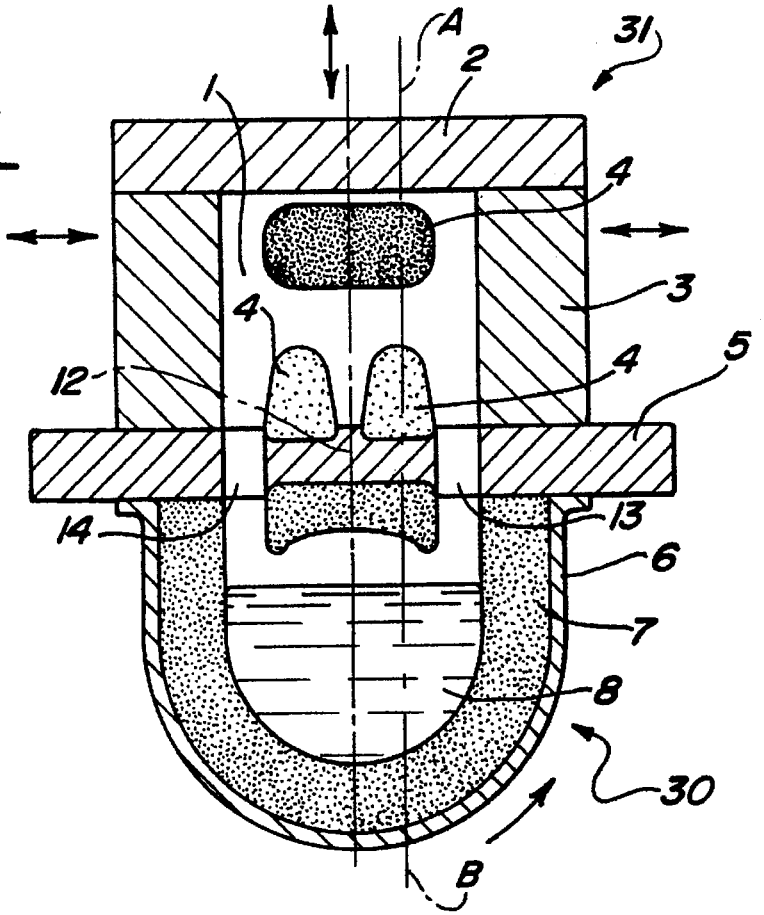
FIG. 2 is a vertical section through a casting container with a mould according to FIG. 1, extending perpendicularly relative to the rotational axis.

FIG. 2 again shows the mould 31 with the mould cavity 1, consisting of the mould cover plate 2, side parts 3, cores 4 and the mould base plate 5. The ingate 13 and a communication therefore channel 14 extending parallel thereto are identifiable in the base plate 5. The casting container 30 can be seen to comprise the housing 6, the refractory lining 7 and contains the quantity of melt 8 metered so as to be sufficient for one casting operation.

By rotating the entire casting equipment anti-clockwise around the rotational axis 12, the melt flows through the ingate 13 With a large cross-section in a quiet, turbulence-free way into the mould cavity 1 and completely fills same within a few seconds. At the end of the rotational movement, the casting container 30 is positioned above the mould base plate 5. Now, by means of the pressure connection 11, the internal pressure, especially the protective gas pressure, is increased above the melt which solidifies in the mould cavity 1 and whose total volume also comprises the necessary feeder volume, as a result of which dense feeding conditions for the casting are ensured. After completion of the solidification process, the excess pressure may be reduced to normal pressure, the mould may be opened, and the sufficiently cooled casting may be removed, whereupon a new casting cycle begins.

Arrows at the side of the mould side parts 3 symbolise the direction of movement thereof for the purpose of removing the casting from the mould.

Figure 3:
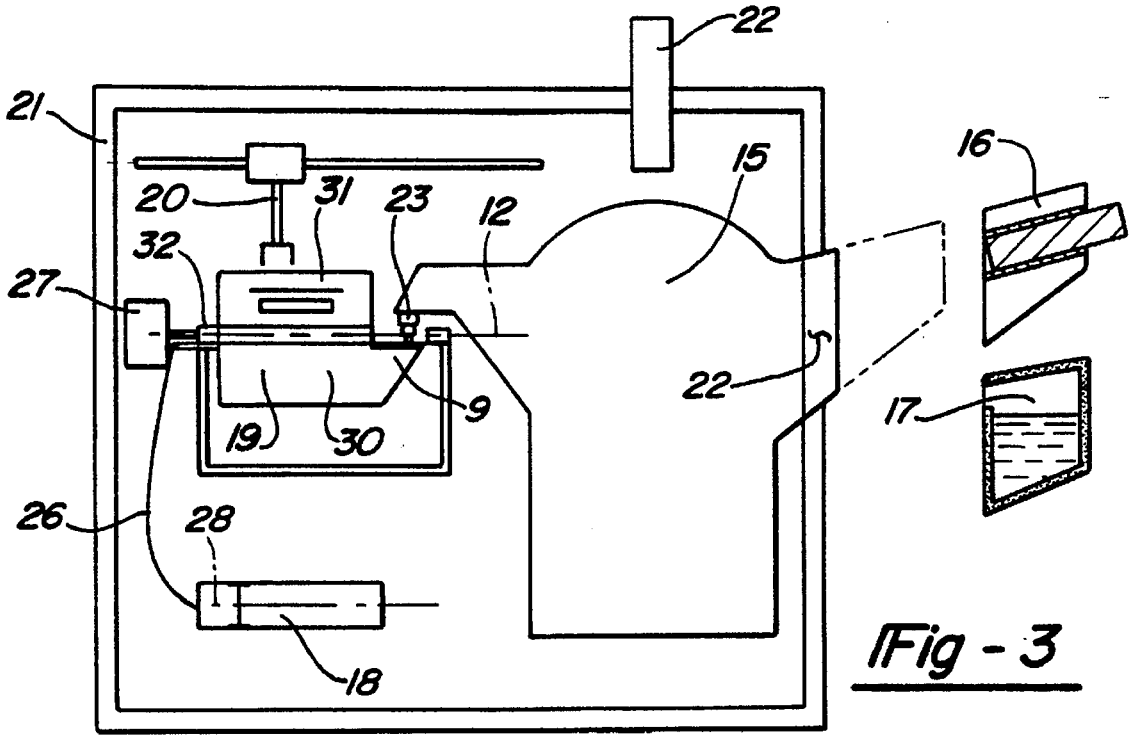
FIG. 3 is a systematic illustration of a casting cell having the equipment suitable for carrying cut the processes in accordance with the invention.

FIG. 3 shows, inside a casting cell 21, a rotatable casting device 19 with a rotary drive 27 as well as a casting container 30 and a mould 31 with connecting means 32 connecting same. The rotational axis 12 of the casting device is also shown. By means of a pipeline 26, the casting container 30 is connected to a pumping and storage system 18, 28 illustrated symbolically only. Within the casting cell 21, there is arranged a metering furnace 15 which, by means of a resilient gas-proof coupling 23, is connected to the filling aperture 9 of the casting container 30. By means of a sluice 22, the metering furnace 15 is connected to a region outside the casting cell 21. The sluice 22 may alternatively be connected to a charging device 16 for lumpy material or to a charging device 17 for liquid material. The casting cell comprises a further sluice 22. Above the mould 31 there is shown a manipulator 20 for the cores.

Figure 4:
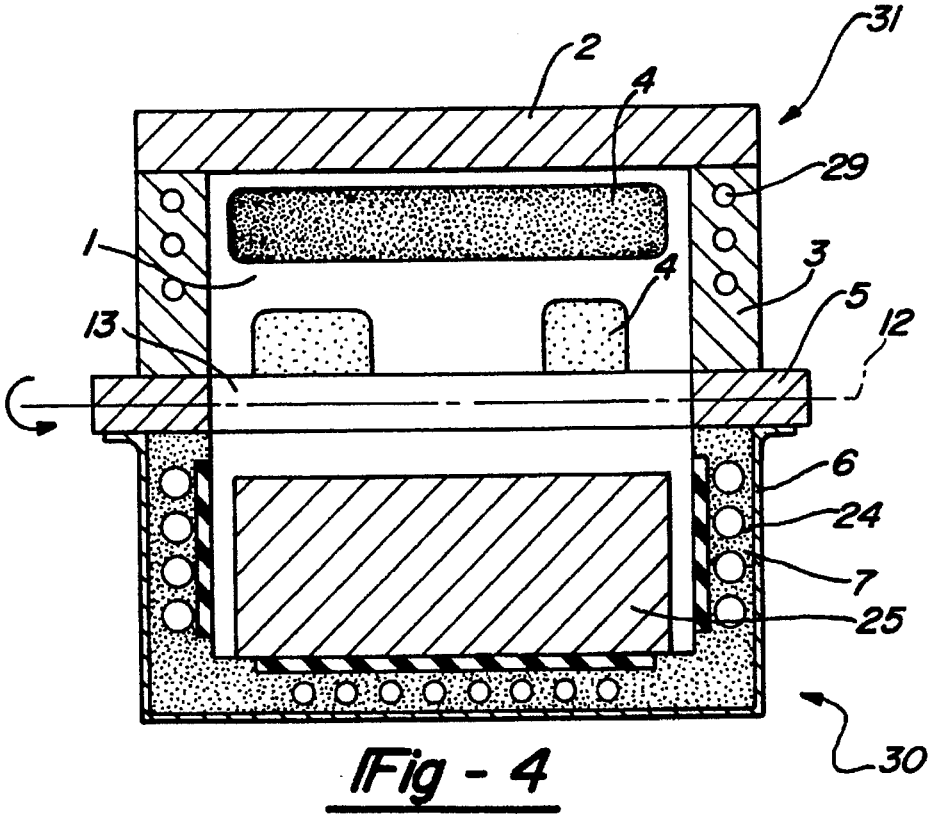
FIG. 4 is a vertical section through a casting container with a mould through the rotational axis in a second embodiment.

FIG. 4 shows a casting device consisting of a casting container 30 and a mould 31.

The casting container 30 differs from that shown in FIG. 1 in that it does not comprise a filling aperture. However, within the refractory lining 7 it comprises heating means 24. A solid quantity of metal 25 has been inserted into the casting container 30. In its cross-section extending perpendicularly relative to the rotational axis 12, said casting device corresponds to that shown in FIG. 2.

The mould 31 substantially corresponds to that shown in FIG. 1. It comprises a mould cover plate 2, mould side parts 3 and a mould base plate 5. However, the side parts are shown to comprise cooling means 29. Cores 4 are inserted into the mould. The rotational axis of the device has been given the reference number 12.

We claim:

1. A process for casting components from metal alloy, by rotating an apparatus comprising a mould (31) and casting container (30);

said mould having a mould cavity (1) and said casting container having an interior for containing a melt, said mould and casting container held in fixed relationship to one another, wherein said container is located below said mould prior to rotating;

said apparatus further comprising at least one ingate (13) which extends substantially from one end of the mould to an opposite end of said mould in a horizontal direction along an axis of rotation, said ingate providing an open connection between said mould cavity (1) of said mould (31) and the interior of the casting container;

said apparatus also comprising at least one communication channel (14), which provides an additional open connection between the mould cavity (1) and the casting container (30);

the casting process comprising:

rotating the apparatus so that the casting container (30) is located below the mould (31);

filling the casting container (30) with sufficient melt for a single casting, with both the at least one ingate and the at least one communication channel being free of melt prior to rotating;

sealing said casting container so as to be gas-proof;

rotating the apparatus around a horizontal axis (12) in such a way that the melt is conveyed into the mould (31), with the flow of melt being effected through the at least one ingate and with a flow of gases being effected through the at least one communication channel (14) at a beginning of said rotating step;

further rotating said apparatus until said casting container (30) is positioned above said mould (30) and said mould cavity (1), said at least one ingate and said at least one communication channel are filled with melt, wherein said at least one ingate and communication channel act as raisers;

pressurizing the interior of the casting container at least temporarily during the mould filling and solidification process.

2. A process for casting components from metal alloy, by rotating an apparatus comprising a mould (31) and casting container (30);

said mould having a mould cavity (1) and said casting container having an interior for containing a melt, said mould and casting container held in fixed relationship to one another, wherein said container is located below said mould prior to rotating;

said apparatus further comprising at least one ingate (13) which extends substantially from one end of the mould to an opposite end of said mould in a horizontal direction along an axis of rotation, said ingate providing an open connection between said mould cavity (1) of said mould (31) and the interior of the casting container;

said apparatus also comprising at least one communication channel (14), which provides an additional open connection between the mould cavity (1) and the casting container (30);

the casting process comprising:

rotating the apparatus so that the casting container (30) is located below the mould (31);

filling the casting container (30) with sufficient melt for a single casting, with both the at least one ingate and the at least one communication channel being free of melt prior to rotating;

sealing said casting container;

rotating the apparatus around a horizontal axis (12) in such a way that the melt is conveyed into the mould (31), with the flow of melt being effected through the at least one ingate and with a flow of gases being effected through the at least one communication channel (14) at a beginning of said rotating step;

further rotating said apparatus until said casting container (30) is positioned above said mould (30) and said mould cavity (1), said at least one ingate and said at least one communication channel are filled with melt, wherein said at least one ingate and communication channel act as raisers; and wherein a feeding volume of the melt remains in the ingate (13) and the communication channel (14).

3. A process according to claim 1 wherein the casting container (30) is filled with a quantified amount of metal (25) in a solid form for one casting operation and sealed so as to be gas-proof, and melting the metal.

4. A process according to claim 2 wherein the casting container (30) is filled with a quantified amount of metal (25) in a solid form for one casting operation and tightly sealed, and melting the quantity of melt for one casting operation.

5. A process according to claim 1 or 2, wherein the casting container (30) for the melt is first flushed with protective gas, then filled with said quantity of liquid melt (8) for one casting operation under protective gas and finally sealed so as to be gas-proof, and subsequently the melt is conveyed into the mould (31) under protective gas.

6. A process according to claim 5 wherein at least temporarily during the mould filling operation and the solidification process, the pressure of the protective gas in the interior of the casting container (30) is increased.

7. A process according to claim 5 wherein after completion of the mould filling operation or the solidification process, the protective gas used is recovered for re-utilization during the pressure relieving process.

8. A process according to claim 5 wherein the air is largely evacuated from the casting container (30) before it is flushed with protective gas.

9. A process according to claim 3 or 4, wherein the casting container (30) for the melt after being sealed so as to be gas-proof, then is flushed with protective gas and the mount of metal (25) is melted for the quantity of melt for one casting operation and subsequently the melt is conveyed into the mould (31) under protective gas.

10. A process according claim 2 or 4, wherein part of the melt remains in the entire cross-section of the casting container (30) in the form of a feeding volume.

11. A process according to claim 2 or 4, wherein at least temporarily during the mould filling operation and the solidification process, the pressure in the interior of the casting container (30) is increased.

12. A process according to one of claims 1, 8, 2 and 4, wherein the longitudinal axis of the mould cavity (1) for an oblong component extends in the direction of the rotational axis (12).

13. A process according to one of claims 1, 3, 2 and 4, wherein a mould cavity (1) is provided with cores (4) extending as far as the cross-section of the ingate.

14. A process according to one of claims 1, 3, 2 and 4, wherein the position of the ingate (13) is adapted to the geometry of the mould cavity (1) in such a way that the melt moves in a turbulence-free way underneath the closed bath surface, in accordance with the principle of communicating tubes, from the casting container (30) into the mould cavity (1).

15. A process according to one of claims 1, 3, 2 and 4, wherein the at least one communication channel (14) extends substantially along the component length, parallel to the ingate (13).

16. An apparatus comprising a mould (31) and casting container (30);

said mould having a mould cavity (1) and said casting container having an interior for containing a melt and having a volume for holding a quantity of melt for a single casting;

a connecting means for holding said mould and casting container in a fixed relationship to one another, and said container is located below said mould prior to rotating;

rotary driving means for rotating the casing container (30) together with the mould (31) around a horizontal axis (12);

at least one ingate (13) which extends substantially from one end of the mould to an opposite end of said mould in a horizontal direction along an axis of rotation, said ingate providing an open connection between said mould cavity (1) of said mould (31) and the interior of the casting container; and at least one communication channel (14), which is distal from the at least one ingate (13) transverse with respect to the direction of the horizontal axis and provides an additional open connection between the mould cavity (1) and the casting container (30).

17. A device according to claim 16 wherein there are provided sealing means (10) for sealing the casting container in a gas-proof way, and pressure increasing means (18) for increasing the internal pressure in the casting container.

18. A device according to claim 16 or 17 wherein the communication channel (14) substantially extends along the component length, parallel to the ingate (13).

19. A device according to claim 16 or 17, wherein the width of the ingate (13) is substantially constant and small relative to its length.

20. A device according to claim 16 or 17, wherein the casting container (30) together with a mould (31) is rotatable around a longitudinal axis positioned in a cross-sectional plane of the ingate (13).

* * * * *

UNITED STATES PATENT AND TRADEMARK OFFICE

CERTIFICATE OF CORRECTION

PATENT NO. : 5,626,180

DATED : May 6, 1997

INVENTOR(S) : Friedhelm Kahn, Joachim Kahn

It is certified that error appears in the above-indentified patent and that said Letters Patent is hereby corrected as shown below:

Column 1, line 11, "workpiece" should be --workpieces--

Column 2, line 26, "preferred" should be --referred--

Column 2, line 36, "end/or" should be --and/or--

Column 3, line 5, "inferior" should be --interior--

Column 3, line 45, "motoring" should be --metering--

Column 6, line 54, "cut" should be --out--

Column 7, line 12, "In" should be --An--

Column 7, line 18, after "communication", delete "therefore"

Column 7, line 25, "With" should be --with--

Column 8, line 43, Claim 1, "mould (30)" should be --mould (31)--

Column 9, line 18, Claim 2, "mould (30)" should be --mould (31)--

Column 9, line 55, Claim 9, "mount" should be --amount--

Signed and Sealed this

Thirtieth Day of December, 1997

Bruce Lehman

*Attest:*

BRUCE LEHMAN

*Attesting Officer*

*Commissioner of Patents and Trademarks*